US005472571A

United States Patent [19]

Niemi

[11] Patent Number: 5,472,571

[45] Date of Patent: Dec. 5, 1995

[54] METHOD AND APPARATUS FOR CONTROL OF THE DRY LINE OR FOR CONTROL BASED ON THE DRY LINE IN A FOURDRINIER PAPER MACHINE

[75] Inventor: Antti J. Niemi, Yrjö Liipolantie 5, SF-02700 Kauniainen, Finland

[73] Assignees: Antti Johannes Niemi; Ulla Ritta Anneli Niemi, both of Kauniainen, Finland

[21] Appl. No.: 150,077

[22] PCT Filed: May 22, 1992

[86] PCT No.: PCT/FI92/00161

§ 371 Date: Nov. 18, 1993

§ 102(e) Date: Nov. 18, 1993

[87] PCT Pub. No.: WO92/20861

PCT Pub. Date: Nov. 26, 1992

[30] Foreign Application Priority Data

May 23, 1991 [FI] Finland ..... 912515

[51] Int. Cl.[6] ..... D21F 11/00

[52] U.S. Cl. ..... 162/198; 162/252; 162/253; 162/258; 162/259; 162/262; 162/263; 162/DIG. 10; 162/DIG. 11

[58] Field of Search ..... 162/198, 262, 162/263, DIG. 10, DIG. 11, 252, 253, 258, 259

[56] References Cited

U.S. PATENT DOCUMENTS 4,831,641 5/1989 Niemi ..... 377/53

5,011,573 4/1991 Niemi ..... 162/198

FOREIGN PATENT DOCUMENTS 1360992 7/1974 United Kingdom ..... 162/263

*Primary Examiner*—Peter Chin

*Attorney, Agent, or Firm*—Felfe & Lynch

[57] ABSTRACT

The system effects an automatic observation of the dry line on wire of the Fourdrinier paper machine and the control actions based on it. In order to produce an image of the dry line range on wire this is illuminated by means of a large, diffusely illuminating surface (20) of even luminosity. The material on moving wire (10) is imaged by an optoelectric camera (40) on a detector whereby the pulp surface preceding the dry line and being specularly reflecting is found homogeneous and bright while the web surface following it and being diffusely reflecting is found homogeneous but matter and darker. The electric image signal delivered by the detector is conducted to a computer (50) in which the dry line is identified as the borderline of said surfaces of different brightness. Its deviations from target values are determined for both the average value and different values in cross direction and the corresponding actuators are adjusted in order to control the paper web on the basis of deviations observed for its different parts or for its whole breadth. Dry line and values of quantities and deviations characterizing it are also presented on a display terminal, whereby said controls can alternatively be effected by a human observer.

11 Claims, 2 Drawing Sheets

METHOD AND APPARATUS FOR CONTROL OF THE DRY LINE OR FOR CONTROL BASED ON THE DRY LINE IN A FOURDRINIER PAPER MACHINE

BACKGROUND OF THE INVENTION

The present invention relates to a method for monitoring of the dry line and for control based upon the dry line in a Fourdrinier paper machine. The invention also relates to an apparatus for carrying out said method.

Essential part of the Fourdrinier paper machine is the plane wire on which the dilute wood fibre pulp is fed and on which it settles forming a web. The web formation process essentially determines the quality of final product, since a major part of the water in pulp is removed through the wire, and the position of fibres with regard to each other does not change any more in the dryer part following the wire. The most important actuators which affect web formation and through it the quality of the paper or board are located in advance of the wire or in its immediate neighbourhood.

In order to reach a final product of even quality, it is important that the properties of the pulp web are measured as early as possible, i.e. already at the wet end of the paper machine. By means of stated actuators one may then reach a fast control and avoid the delay which is characteristic to conventional control based on measurements carried out at the dry end. However, practical methods for direct measurement of the pulp web at the wet end have been almost completely missing until recent times. The invention to be described lower down presents a new method for measurement at the wet end and control based on it.

The method of measurement to be presented is directed to the dry line which is related to the disappearance of water from the surface of the pulp web and is found at the location were the water or liquid (fluid) which behaves like water vanishes from said surface. The part of the web which precedes this location can be found glossy or specularly reflecting, due to the light reflected at places by it, while such a gloss cannot be observed on the part following the dry line.

In an industrial paper machine, the dry line is irregular in the cross direction and at the same time variable also in the machine direction. The gloss of the water surface found at an inspection of the wire is not uniform, but consists of spots which being brighter than their environment transmit light reflecting it from various sources of light, like from lamps of the factory hall, to eyes of the observer. A spot corresponding to even a single source of light is then indefinite and scattered, because it is not the simple mirror image of that light source which is observable to the eye, but a nonuniform, glossy area which is limited for its size and has an indefinite boundary line, because the water surface of pulp above the moving wire and pulp layer is not very even and because its local inclination is variable. The glossy area on the web surface sometimes extends sometimes not to the dry line and the water surface of pulp forms narrow, long peaks whose observation is made particularly difficult by the unevenness of the gloss.

Despite of the deficient observing of the dry line, the machine operator relies regularly on his observations on it in some of his control actions, i.e. in local or remote adjustment of manually controllable actuators, also in the case of a paper machine which has been provided with automatic controls based on quantities measured at dry end or dryer part. In order to obtain a picture of the dry line in its totality, he has then to inspect the wire from different directions in order to observe such, reflecting spots which are limited By the dry line at its different locations. According to his subjective observations he concludes the deviation of the dry line from the wanted location, both for the average value and in order to adjust the feed flow at different locations of the cross direction.

In order to observe the dry line instrumentally, one has in some cases inspected the wire by means of a single, photoelectric detector or an optoelectric camera which may be conventional television camera or a camera based on semiconductor detector which consists of discrete elements being used in the manner which appears from the British patent No 1430420 or corresponding U.S. Pat. No. 4,831,641. In these connections one has also stated the possibility of using electromagnetic radiation which is outside the wavelength range of visible light, analogously with the use of visible light, for observation of physical object. The use of these detectors as such does not, however, result in a clear and correct image of dry line, nor in correct values of quantities which characterize it. This is due to reasons which are already known from the visual observation of the man and which mislead an instrumental observation. If the number or power of light sources is increased, difficulties are by no means decreased. On the contrary, the numbers and contrasts of separate glossy areas and levels of brightness grow up and the blinding increases which further hampers instrumental observation. In addition to this, the determination of the dry line by computer from an indefinite camera signal requires a complicated computer program and results in computations which demand much time, if it can be carried out at all with an accuracy required by the control of the web.

The described difficulties do not not appear in the method according to the Finnish patent No 75887 or the corresponding U.S. Pat. No. 5,011,573. In this method the wire is illuminated in such an angle that direct reflections from the surface preceding the dry line are not brought up and direct reflection of other light sources is also prevented. Under such conditions, the part following the dry line which reflects diffusely the light it receives, is observed, due to this light which it emits, as a brighter part of the pulp web than the part preceding the dry line.

The last method above detects the dry line in industrial use continuously with a good accuracy, as a data set which is renewed repeatedly. The change of power of illumination in the cross direction of the wire which is present in the method does not essentially hamper the use of the method, but may require the illuminators to be located a longer way out from the wire in order to reach a more even profile of illumination. In such a case, the need of illuminative and therefore electric power increases, especially if a dark pulp is observed which after the dry line absorbs a considerable part of the light. In some cases the structures or auxiliary devices of the paper machine may, for their part, prevent a practical installation or maintenance of the equipment implied by the method, if the components to be maintained are located e.g. above the wire. The new method to be disclosed in the following produces a more even and at same time not blinding illumination and this way a detection of the dry line and control of the web at an essentially lower electric power than the method presented by the patent. It can also be carried out in many such paper machine environments to which the patented method does not apply for structural reasons.

SUMMARY OF THE INVENTION

It is characteristic to the new method that the wire is not at all illuminated directly, but only indirectly, by a large surface which transmits light evenly so that bright, blinding spots are not formed on the wire. The primary light source illuminates or the primary sources illuminate this surface which typically is diffusely reflecting. For formation of an image of the wire, an optoelectric camera is used in whose image plane a real image is formed of the surface of wire and especially of the whole area in which the dry line normally appears and to which the indirect illumination is primarily aimed. The camera is so located that it receives light emitted by the illuminated surface and reflected by the surface preceding the dry line. From the part following the dry line it receives a smaller part of that light which, arriving from the illuminated surface, is reflected diffusely from the pulp web following the dry line. If light is transmitted to the detector from the general illuminators of the factory hall or from other light sources which are extraneous to the system, by reflections via the imaged area of the wire, such disturbing sources are switched off or the reflections are prevented with shades.

DETAILED DESCRIPTION OF THE PREFERRED EMBODIMENT

Figure 1:
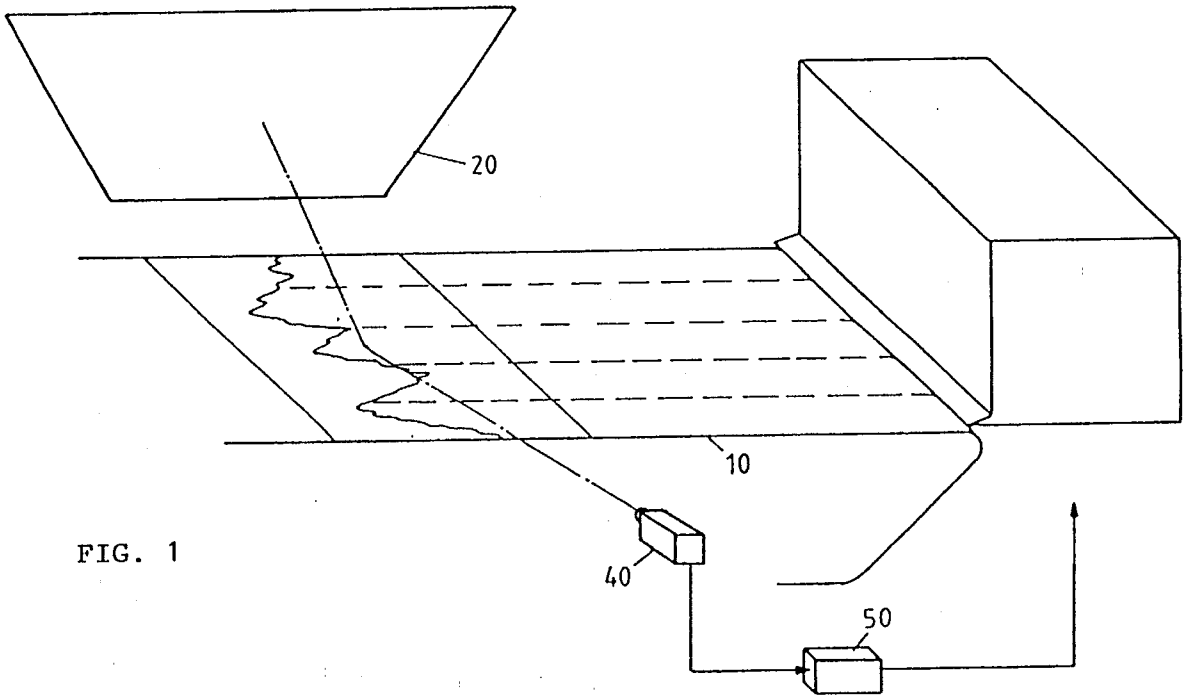
FIG. 1 presents the wire part of paper machine, the dry line, its interesting range of appearance and illumination and camera observation of this range.

At the manufacture of paper, the pulp arrives from the head box onto the moving wire whose interesting part is, in the method according to the invention, observed with an optoelectric camera in order to produce an image signal and transfer it to the computer which determines the dry line and controls the actuators of the paper machine. In the typical embodiment according to FIG. 2 no light arrives from the light source 30 directly to the camera 40 nor to the wire 10. Instead of that the diffusely reflecting surface 20 is powerfully and evenly illuminated. This is reached by the use of an appropriate reflector behind and in the neighbourhood of the light source 30. Several light sources may be used for the same reason. They with their reflectors may be placed near the different edges of the surface 20, provided that direct radiation of light from them to the camera or from them to the wire and further on to the camera is prevented.

The part of wire preceding the dry line reflects light which arrives on it. The smaller is the angle of arrival, the more complete is the reflection. The part following the dry line receives an equal illumination, but since it reflects this diffusely into the total half-space above, it emits in the direction of camera much less light than a corresponding surface element at the part preceding the dry line. Therefore the camera finds the part of wire preceding the dry line brighter than the part following it. The effect is strengthened further, if the web found downstream of the dry line absorbs light. The dry line is detected from the viewed signal transferred to the computer 50, as the borderline (set of points) of the brighter early part and darker late part, by means of an appropriate edge detection algorithm.

Under illumination in the manner described the camera receives light from the total range of appearance of the dry line within which it is wanted to be observed. If the wire would be illuminated directly by lamps or other separate lights sources, parts of the stated range would necessarily remain dark, as viewed by the camera. The method also excludes the presence of such blinding spots in the scene which are caused by direct light sources and which would disturb the observation of dry line as they are reflected by the pulp surface to the camera and would in practice prevent the analysis of the image in computer.

If an area which immediately precedes the dry line on the wire 10, presumably on the same side of the wire as the surface 20 receives light in a wide angle from various points of the surface 20, the main part of this light is refracted into the pulp layer and reflected diffusely by fibres within it or in the fibre layer condensed next to the wire. Considerable part of this light returns to the half-space above the wire and a part of this is accordingly directed to the camera. With regard to this component of light, the surface preceding the dry line acts almost equally to the surface following it and the absolute difference in brightness is therefore essentially determined by the light reflected directly from the surface of the lean pulp. It is logical to choose the size and position of the surface 20 in such a way that the angle a ($a_1 \geqq a \geqq a_2$) according to the projection presented in FIG. 2, in which angle the light which is reflected to the camera from the surface of lean pulp both leaves the wire and arrives on it, is sufficiently small so that a good difference of brightness is reached within the total range of dry line, and that the height of the surface 20 corresponds to the above total range of the angle; i.e. the surface 20 is to be so high that it in the field of view of the camera 40 and taking the reflection from the wire into account covers at least the same angle of view as the wire.

Figure 2:
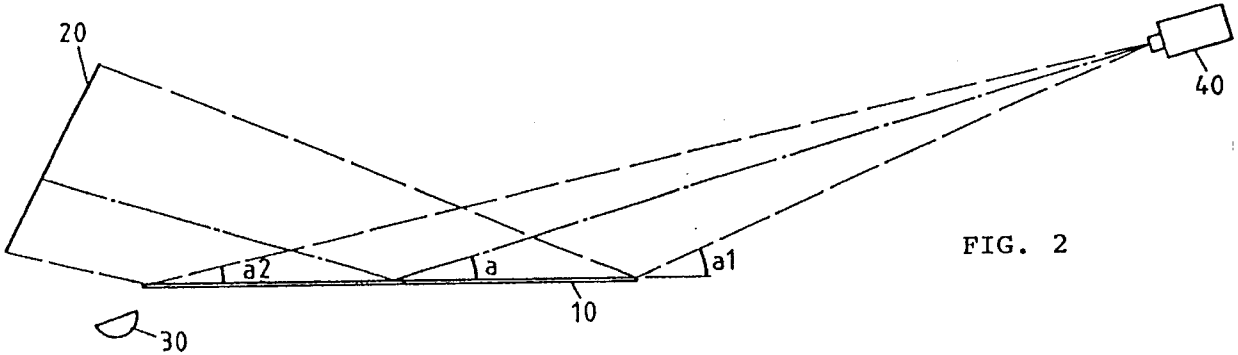
FIG. 2 presents the wire, its indirect illumination, rays of light reflected by the surface preceding the dry line, and the camera.

In the embodiment according to FIG. 2, the primary illuminators illuminate the surface 20 from its front side. In order to reach the wanted even, diffuse illumination, the surface 20 has been treated with an suitable agent which may be a white dye or e.g. aluminium bronze or fluorescent substance, but also white paper, cloth or oilcloth are mostly applicable. Diffuse illumination can also be reached through a translucent, light scattering plate which is illuminated from the back side or to which light is conducted via its edges, or through a plate having a self-luminescent surface. It is essential that the surface 20 emits even, diffuse light at least in the direction of the dry line range on the wire so that light arrives to all areas of the dry line range also in the angles a according to FIG. 2. This can be effected, if a coating material is used which reflects both diffusely and directionally and if the inclination of the surface 20 is chosen according to the stated aim; except a plane, the surface 20 may be bent or e.g. built of segments.

The optical distance from camera to surface 20 corresponding to different values of the departure angle a are, according to an inspection of the vertical projection in FIG. 2, almost equal in the case of specular reflection from the wire and also in that of diffuse reflection. In the latter case each surface element of the mass reflects diffusely and emits to the half-space above the wire and therefore also to the camera, light which it has received from the whole area of surface 20. Therefore the pulp surface preceding the dry line is found almost homogeneous for its brightness in the corresponding direction across the whole wire, and the same is valid with regard to surface of the mass following the dry line and to its luminosity.

In the case presented by FIG. 2 the camera sees a trapezoidal area of the wire in whose middle range the dry line normally lies. In order to observe the dry line also at the camera's side of the wire, one has to place the camera at a suitable distance from the wire and not too close to its side. The distance can be shortened as needed, if two or more parallel cameras and an illuminating surface of corresponding dimensions are used. The influence of the geometry of view on the image transferred to the computer can easily by taken into account at the computational processing of the observed image data, i.e. the observation can be corrected to become a geometrically correct image of the wire and dry line which is needed i.a. at determinations of control actions needed at different part of the cross direction. The accuracy required for these determinations and controls like for selection of the lip screws to be controlled sets also a practical low limit to the directional angle of camera and therefore to the values of angles $a_1 \ldots a_2$. It further appears from FIG. 2 that since the camera is located outside the wire and generally the paper machine, its adjustments are easy and its maintenance can always be carried out as needed.

Figure 3:
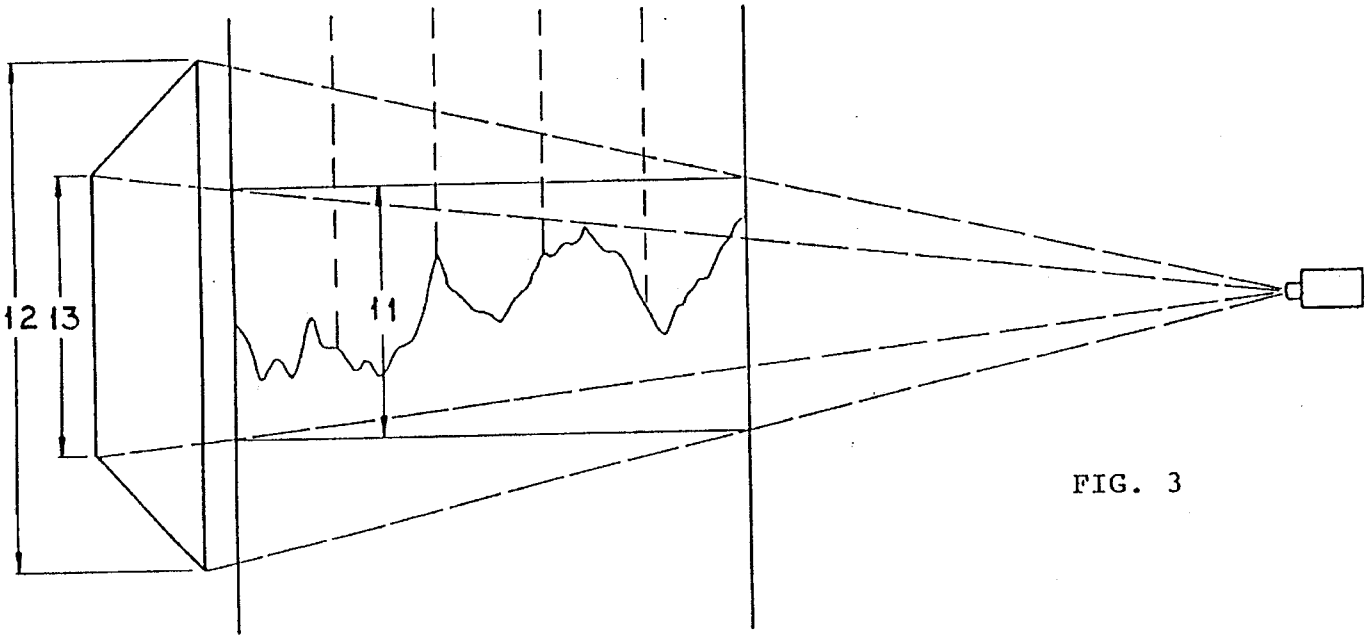
FIG. 3 presents the wire, the dry line, its normal range of appearance on the surface of wire, and dimensions of the surface of indirect illumination.

The horizontal minimum length and location of the surface 20 are determined by the length 11 and location of the interesting area, especially at the side toward the camera. The length of the upper edge 12 of surface 20 has to be larger than the measure 11, as seen from FIG. 3. For the low edge of the surface a measure 13 is sufficient which is only slightly larger than the length of the interesting area on wire, especially if the stated low edge is close to the other edge of the wire. According to FIG. 3 the optical distance from camera to surface 20 increases only a little at transfer from direction of the central optical axis horizontally to sides of surface 20. Therefore the luminosities of the surface preceding the dry line and correspondingly of surface following the dry line change only minutely with the horizontal directional angle.

Figure 4:
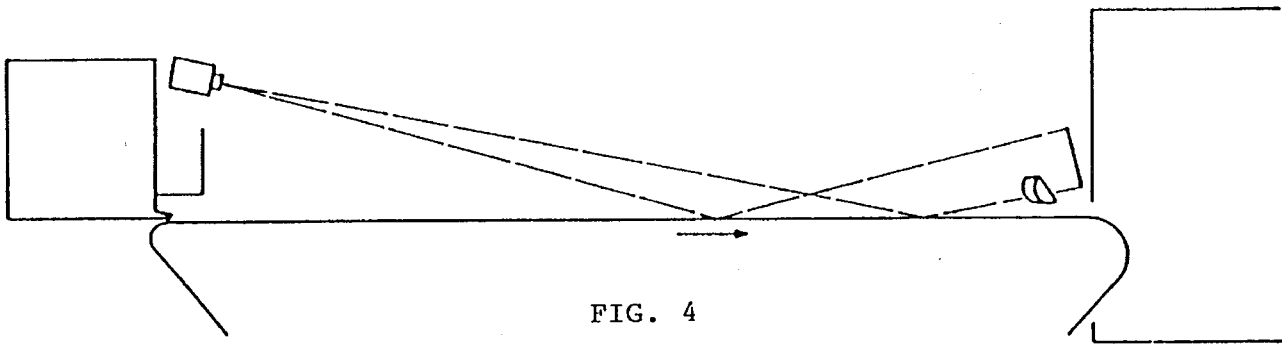
FIG. 4 presents the observation of the dry line in axial direction of the paper machine, whereby the primary light source illuminates obliquely from the side the surface which reflects diffusely light onto the wire.

The structure of some paper machines allows for arrangement of the indirect illumination and of observation based on this, in the axial direction of the machine. The primary sources of light, diffusely illuminating surface and camera can then be located e.g. in the manner presented in FIG. 4. The conditions which determine the positions of the equipment and dimensions of the illuminating surface are analogous with the conditions which relate to the cross directional system presented above. Even another wire of the same multi-wire paper machine and the fibre web on it can then sometimes be used for secondary illumination, if its position and reflectance apply to diffuse illumination of the dry line range of the wire to be observed. In this case one has to additionally install diffusely reflecting auxiliary surfaces at the sides of the stated other wire, so that the wanted dry line range would be observed for its whole breadth. The corrective calculations which are needed in order to form a geometrically correct image of the dry line and its location are easily programmed and executed in such cases as well. From this point of view it is completely possible, if the structure of the paper machine and the other equipment in the factory hall set severe limitations, to position the optical axis of the system to cross the wire even obliquely.

The optics of the camera 40 form a real image of the dry line range of the wire on the electronic detector surface of camera which may be a continuous surface like that in the conventional television camera tube or one consisting of discrete elements like that in semiconductor cameras. Because the camera stands relatively far from the wire, its optics produce without difficulties an accurate image of the whole dry line, and an even smaller accuracy in depth is sufficient for imaging in the axial direction of the paper machine. Repeated transfer to computer of the image data expressed in electrical form and the electronic hardware needed for it represent previously known technology which can be implemented by means of commercially available components. They include the components which differentiate from each other the signal elements which exceed or underpass the luminosity threshold given in electrical form; even several such thresholds may be present.

In order to detect the dry line, the computer is programmed to distinguish in the image signals which arrive or have been intermittently stored in the memory, from each other the areas which are darker or lighter than the given threshold value. Edge detection algorithms which are appropriate to this task have been presented in textbooks on image analysis. The image signals can be previously corrected by software as needed, e.g. in order to take into account nonhomogeneity of brightness of the illuminating surface or to eliminate signals which correspond to field of view extending outside of the wire.

The detected dry line data is compared in the computer with the reference or setpoint data and the control needed by the actuator or actuators is determined on the basis of their difference. Such control actuators are e.g. the control valves for control of the thick stock flow or of level height in head box or vacuum in suction boxes. Other such devices are the components for adjustment of the corresponding local control loops which provide for fast feedback control of the mean value of dry line by means of a conventional, e.g. proportional or P-control algorithm. The transfer of control signals from computer to actuators represents likewise previously known technology. Also the lip screws or corresponding components Which are connected to the lip of the head box slice can be controlled on the basis of differences observed at different points of the cross direction, whereby a difference observed at one point may give an impulse for adjustment of the corresponding screw and of the nearest other screws, in order to produce such a form of the dry line that the quality characteristics of product become as even as possible in cross direction. On the basis of the observed difference one may control in feedforward fashion also actuators located at a later place, especially those in the dryer part which affect e.g. heating and through it the moisture. The actuators stated above are just examples of many such devices whose control can be expediently based on measurement of dry line in the described manner, and which already are generally used either in manual control or in such automatic control which is based on measurement or observation methods of other kind. Neither the computer is required to have any properties which would exceed the abilities of the conventional real-time computer. It can without difficulties be programmed to distinguish also such features in the image which call for special actions or special attention, like a partial or total escape of the dry line from its normal range of presence, and to launch alarms, controls and recordings based on this.

The control system described forms expediently a uniform entity with the described observation system, even if it would be located in a separate computer which receives measurement data from the computer which detects the dry line. Reference or setpoint data are given by the operator of the paper machine through the keyboard, but it may come as a digital signal also automatically from an outside controller whose operation is based e.g. on measurements made at the dry end and their observed deviations from their reference values. A control combined in the latter manner produces in the steady state an even quality of final product, at the same time as the dry line control system presented eliminates fast the effects of dynamic disturbances.

As one control method, reference value signals can be given on basis of dry line data in feedforward fashion, to the feedback control loops of the moisture in paper whose actuators are located in the dryer part of paper machine, or signals directly to these actuators, when in both cases the signals are delayed according to the transport time delay of the web. If the feed of pulp to the wire is simultaneously controlled in feedback fashion on the basis of measurements made at the dry end and especially directed to the dry basis weight, the controls of basis weight and moisture can be accomplished independently of each other or in dependence through the process only, since the fibre composition of the web does not change any more after the dry line. The inclusion of the feedforward component based on measurement of dry line therefore simplifies the control and increases its accuracy as compared with those control methods of basis weight and moisture which presently are in general use.

The dry line detected by the computer, its mean value, sporadic exceptional values and other quantities, features and trends describing the form of dry line are expendiently reproduced by a display terminal or printer, although this is not necessary with regard to automatic control. However, the paper machine operator has at his disposal a number of manually adjustable actuators and control devices and adjusting elements of various controllers which he traditionally controls, for a large part according to his findings on the dry line. Although the described observation and detection system would not be accompanied by automatic control, it makes the control of paper machine essentially better in expressing to the controller the dry line and its characteristic features as well as deviations from the target values and form, including such features which the operator is in no way able to observe nor conclude by other means, and in accomplishing this economically, also in such a paper machine environment which is technologically demanding with regard to installation and maintenance.

I claim:

1. In a method for monitoring of a dry line and for control based on the dry line in a Fourdrinier paper machine having a suction box, a head box, and a wire, said head box having a slice through which pulp is fed onto said wire to form a pulp web, in which the wire and the pulp web on it are illuminated in a region of the dry line and observed optically by forming a two-dimensional image of a whole normal region of appearance of the dry line in a camera in which image a first area of pulp web preceding the dry line and a second area of pulp web following the dry line have a different degree of brightness each and which image is transformed repeatedly to an electrical signal, thresholded and processed digitally, wherein on the basis of data on degree of brightness transmitted by the electric image signal the location of the dry line is determined as the border line between said areas of pulp web and control actions responsive to the location of the dry line are taken, said control actions comprising at least one of controlling vacuum in the suction box, controlling level of pulp in the head box, and controlling the slice opening, the improvement comprising illuminating the wire in said region of appearance of the dry line by means of a large surface of even luminosity, said large surface emitting light diffusely in such a manner that said image is formed optically by means of light reflected to the camera by the whole said region of appearance of the dry line, specularly by said first area and diffusely by said second area.

2. A method according to claim 1, wherein said large surface of even luminosity is illuminated with light emitted by at least one primary source of light.

3. A method for monitoring of the dry line according to claim 1, characterized in that the control actions are effected by a human operator on the basis of the location of the dry line.

4. A method for controlling the dry line according to claim 1, characterized in that control actions include manipulation of slice of head box in the paper machine at different points of slice cross section.

5. A method for controlling the dry line according to claim 1, wherein said machine further comprises a dryer part, said method further comprising measuring the moisture content of the pulp web in the dryer part and adjusting the location of the dry line on the basis of moisture content in the dryer part of the paper machine.

6. In an apparatus for monitoring of the dry line and for control based on the dry line in a Fourdrinier paper machine comprising a suction box, a head box, and a wire, said head box having a slice through which pulp is fed onto said wire to form a pulp web, and means for illuminating said wire and pulp web on it in a region of appearance of the dry line, an optoelectric camera for generating image data for the whole normal range of appearance of the dry line on said wire, a digital computer programmed to determine on the basis of said image data the location of the dry line and means for controlling said pulp web in response to the location of the dry line, said means for controlling said pulp web comprising at least one of means for controlling vacuum in the suction box, means for controlling level of pulp in the head box, and means for controlling the slice opening, said means for illuminating comprising a large surface emitting light diffusely and being illuminated evenly by at least one primary source of light, said diffusely emitted light illuminating the wire and pulp web on it in such a manner that said optical image is formed by means of light reflected to the camera by the whole said region of appearance of the dry line, specularly by a first area of the material surface preceding the dry line and diffusely by a second area following the dry line, whereby more light arrives to a unit area of the detector from the first area than from the second area.

7. An apparatus according to claim 6, wherein the optoelectric camera is situated outside and above the wire and the surface emitting light diffusely is situated such that its mirror image with regard to the wire as seen from the camera covers the same sector as the normal range of appearance of the dry line seen from the camera.

8. An apparatus according to claim 7, wherein at least one primary source of light is situated at a side of the wire and below its height level, the surface emitting light diffusely being at the same side of the wire and above its height level, and the camera at the opposite side of the wire.

9. An apparatus according to claim 7, wherein the primary source of light is situated at an edge of the surface emitting light diffusely so that said surface is illuminated obliquely by said primary source.

10. An apparatus according to claim 7, wherein the surface emitting light diffusely is translucent and the at least one primary source of light is situated behind the surface emitting light diffusely.

11. An apparatus according to claim 6, further comprising an alarm, said digital computer comprising means for launching said alarm when the location of the dry line at least partially escapes said normal range of appearance.

* * * * *